United States Patent [19]

Mihara et al.

[11] Patent Number: 4,679,962

[45] Date of Patent: Jul. 14, 1987

[54] AUTOMOTIVE ROLLING MACHINE

[75] Inventors: Tohru Mihara, Kyoto; Kiyoshi Sato, Yoshikawa; Yasuo Terauchi, Kumagaya, all of Japan

[73] Assignee: Taisei Road Construction Co., Ltd., Tokyo, Japan

[21] Appl. No.: 848,477

[22] Filed: Apr. 7, 1986

[30] Foreign Application Priority Data

Jul. 31, 1985 [JP] Japan ..... 60-168790

[51] Int. Cl.[4] ..... E01C 19/26

[52] U.S. Cl. ..... 404/126; 404/111

[58] Field of Search ..... 404/75, 90, 91, 95, 404/103, 108, 111, 122, 125, 126, 130

[56] References Cited

U.S. PATENT DOCUMENTS 2,138,904 12/1938 Carswell ..... 404/111 X 3,270,634 9/1966 Borges ..... 404/122

FOREIGN PATENT DOCUMENTS 2702813 7/1978 Fed. Rep. of Germany ..... 404/103

*Primary Examiner*—Carl D. Friedman

*Attorney, Agent, or Firm*—Cushman, Darby & Cushman

[57] ABSTRACT

Disclosed is an automotive rolling machine having a main frame section and a lengthy roller equipped to at least one side of the main frame section. The roller is tapered at the outer peripheries of its end portions, whereby, at the time of changing the advancing direction of the roller, the paved surface is not damaged by the outer peripheral angular portions of the roller. The main frame section has a frame at the front and rear end portions of which slider guides are laterally equipped in such a manner that sliders are slidably fitted into the slider guides. At the central portions of the sides of the frame, center pins are vertically supported. And to the underside of the center pins are fixed the central portions of lower frame members supporting the rollers as viewed in the longitudinal direction. The front and rear end portions of the lower frame members are connected to the sliders so that the lower frame members may be movable with respect to the sliders. Thus, the machine has high steerability. In addition, the frame of the main frame section is constructed in the form of a water tank, whereby the machine load is uniformly distributed to enhance the rolling effect.

6 Claims, 5 Drawing Figures

AUTOMOTIVE ROLLING MACHINE

BACKGROUND OF THE INVENTION 1. (Field of the Invention)

The present invention relates to an automotive rolling machine and, more particularly, to an automotive rolling machine which is designed to pave a large flat ground-surface such as that of a tennis court, and which has lengthy rollers that are improved in respect to their steerability.

2. (Description of the Prior Art)

A conventional automotive rolling machine for use on pavement is constructed such that it has rollers at the front and back portions of its machine body. Such a prior art machine is an exclusive rolling machine used for pavement of a large flat ground-surface such as that of a tennis court, and is desired such that it has lengthy rollers which extend in the longitudinal direction of its machine body.

The above-mentioned conventional automotive rolling machine is used in a manner so that its machine body is laterally advanced, since the rollers extend in the longitudinal direction of the machine body and are parallel to each other. It has, however, no steering means while, on the other hand, the ground has no completely uniform horizontal surface. For this reason, it has a drawback that, when it makes its rolling run, its running is affected by the irregularities of the ground surface, thus causing the machine to fail by making it turn leftwards or rightwards.

Conventionally, therefore, in order to prevent the machine from moving in such a curvilinear manner, a bulky article is purposely placed on the ground. By causing one end of the roller to ride over the bulky article, the end portion thereof is less rotated, thereby adjusting the advancing direction of the machine.

However, where such a bulky article is disposed, the opposite end of the roller is temporarily stopped from advancing, whereby the rolling effect becomes excessive at the corresponding ground surface. For this reason, the paved surface often became locally irregular, failing to have complete flatness.

Further, the automotive rolling machine is heavy in weight, and it is therefore extremely difficult to adjust the direction of advance of the machine. For the reason there is a high risk associated with a manual disposition of the bulky article beneath the roller. Thus, efficiency of the conventional machines were greatly reduced by irregular surfaces.

In order to solve the above-mentioned problem, the applicant of the present application previously proposed an automotive paving roller machine having its rollers equipped with a steering means as disclosed in Japanese Utility Model Application Disclosure No. 203708/84.

In this steering means, however, when one of the two parallel rollers is used for changing the advancing direction, its movement varies from a parallel posture to a V-shaped posture as taken in comparison with the other roller. In this case, the directing roller revolves less at the base end portion then it revolves at the tip end portion. That is, when the advancing direction is changed, a difference is produced between the rolling effect of the former and that of the latter. Further, it is difficult to alter the advancing direction at the time of going backwards although it is possible to alter at the time of going forwards.

SUMMARY OF THE INVENTION

The present invention has been achieved under the above-mentioned existing circumstances and the object thereof is to provide an automotive rolling machine having smoothly steerable rollers.

To attain the above object, according to one aspect of the invention, there is provided an automotive rolling machine which has a main frame section, and in which a lengthy roller is attached to the underside of at least one side of the main frame section as viewed in the longitudinal direction, comprising a frame formed in the main frame section, the frame being constructed as a water tank.

According to another aspect of the invention, there is provided an automotive rolling machine in which the roller is formed, at the outer peripheries of its end portions, with tapered surfaces.

According to still another aspect of the invention, there is provided an automotive rolling machine which has a main frame section and in which a lengthy roller is attached to at least one side of the main frame section as viewed in the longitudinal direction, comprising a frame formed in the main frame section, laterally extending slider guides provided at the front and rear of the underside of the frame, respectively, sliders for steering the rollers, which are slidably fitted into the slider guides, center pins provided at the central portions of the sides of the frame as viewed in the longitudinal direction thereof, respectively, in such a manner that the center pins are supported in their vertically erected posture, and lower-frame members for supporting the rollers, which are fixed, at their central portions as viewed in the longitudinal direction, to the undersides of the center pins respectively, the lower-frame members being movably connected, at its front and rear end portions, to the sliders.

According to the invention having the foregoing construction, the roller can be rotated about the center pin provided at the central portion of the roller as viewed in the longitudinal direction thereof, whereby the automotive rolling machine can smoothly undergo a change in the advancing direction.

Since the outer peripheral portions at both ends of the roller are tapered, it is possible to prevent the paved surface from being impaired by the both end portions when the advancing roller direction is changed. Further, since the main frame of the machine is constructed as a water tank, the weight of the machine body can be increased by filling water in the main frame, whereby it is possible to enhance the rolling effect. Further, the water tank may be utilized to sprinkle water out over the outer peripheral surface of the rollers.

DESCRIPTION OF THE DRAWINGS

The drawings illustrate an automotive rolling machine as a whole in accordance with the present invention.

DESCRIPTION OF THE PREFERRED EMBODIMENT

Figure 1:
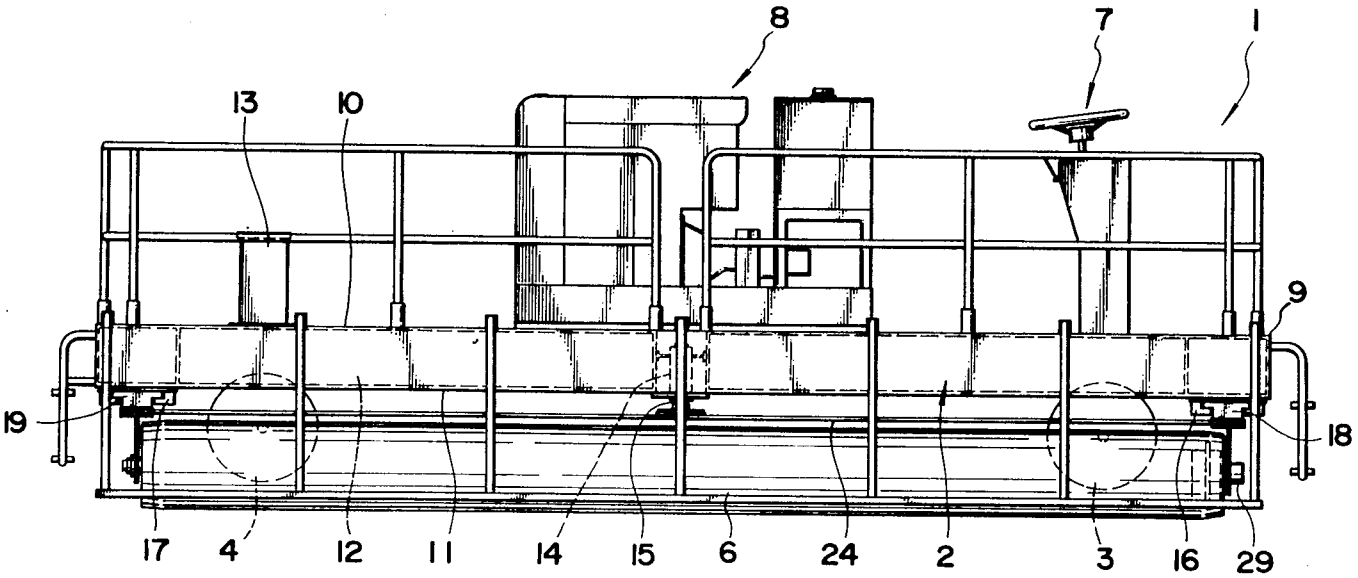
FIG. 1 is a side view of the automotive rolling machine.
Figure 2:
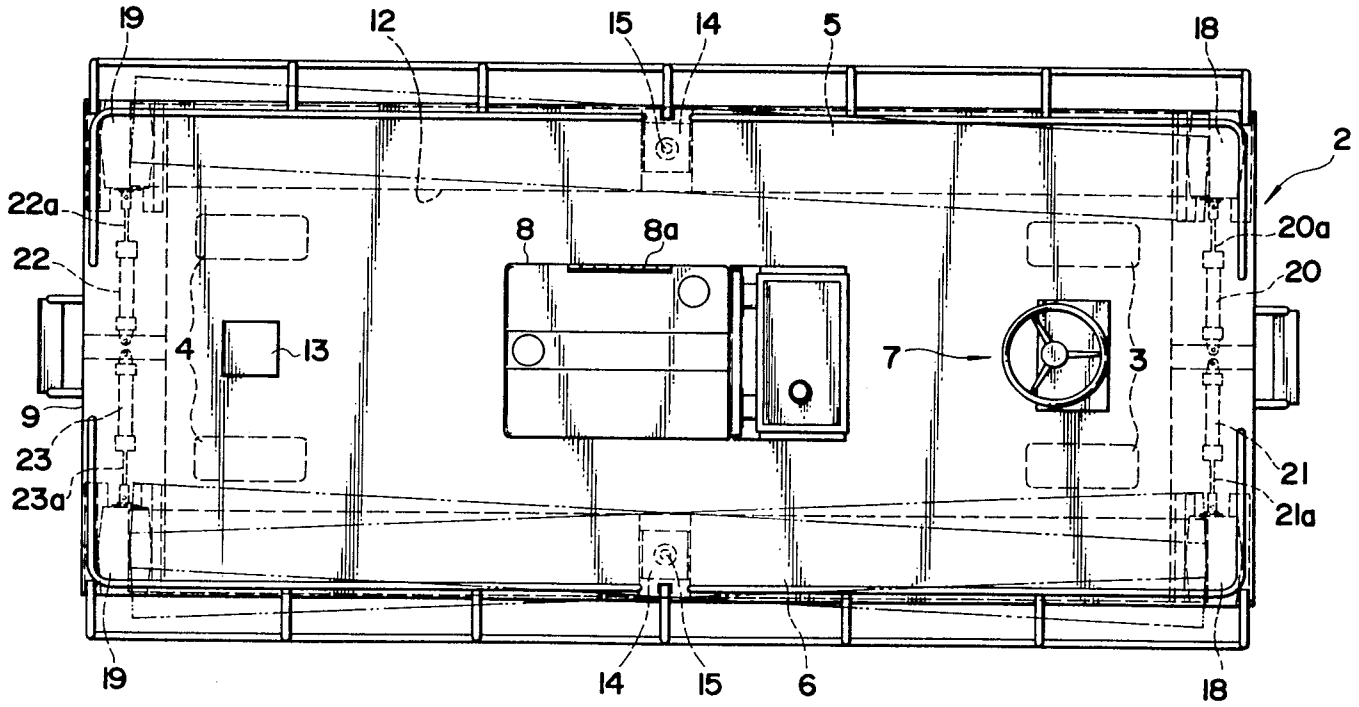
FIG. 2 is a plan view thereof.
Figure 3:
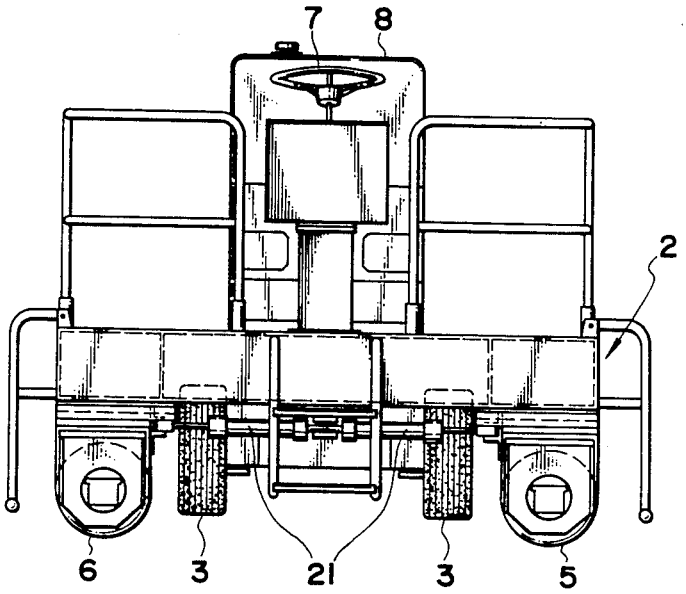
FIG. 3 is a front view thereof.
Figure 4:
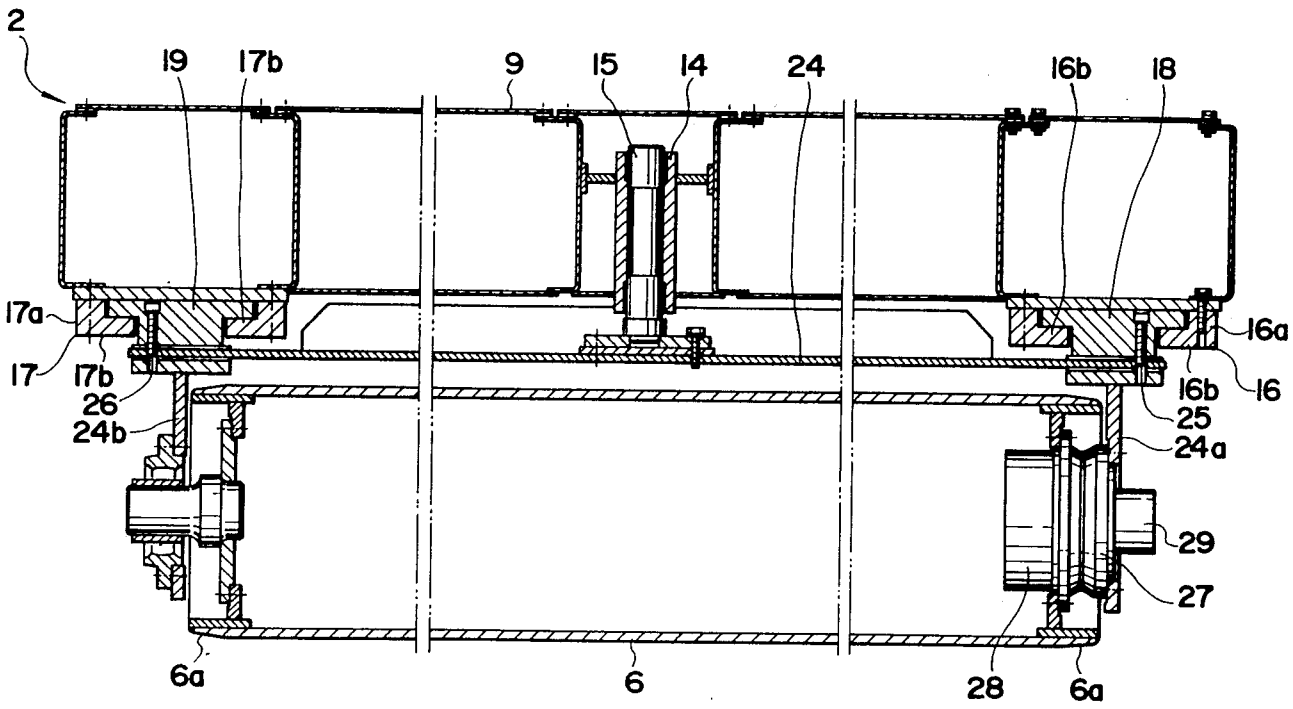
FIG. 4 is a side view of an essential part thereof, which shows the relationship between the roller and the main frame section; and, FIG. 5 is a plan view showing the manner in which the advancing direction of the roller is changed.

A preferred embodiment of the invention will now be described. The drawings illustrating an automotive rolling machine in accordance with the invention, FIG. 1 is a side view of the automotive rolling machine, FIG. 2 is a plan view thereof, FIG. 3 is a front view thereof, and FIG. 4 is an enlarged side view of the roller. The automotive rolling machine has a main frame section 2, and has running wheels 3,4 at the front lower and back lower portions (the rightward portion of the drawing is the forward section of the machine) thereof, said running wheels 3, 4 being so arranged that they are liftable. Further, the machine 1 has freely steerable rollers 5, 6 at the lower portions of both sides of the main frame section 2. In the drawings, a reference numeral 7 denotes a steering means intended to steer the running wheels 3, 4. A reference numeral 8 denotes a drive section including a driver means and a drive control means. The steering means 7 as well as the drive section 8 is of substantially the same mechanism as that of an ordinary construction machinery.

The main frame section 2 comprises a frame 9, said frame 9 being constructed as a rectangular flattened unit, an upper plate 10 provided on the top of the frame 9 over the entire region surrounded by the same in the same manner as in an ordinary car-body frame, a lower plate 11 provided on the underside or lower inside of the frame 9 surrounded by the same, and a water tank 12 thus formed in the frame 9, a water feed section 13 being provided on a portion of said upper plate 10 located at the rear top part of the main frame section 2 in such a manner that it may communicate with said water tank 12.

A pair of bearing blocks 14 are provided at the central portions of the sides of the frame 9, respectively, in such a manner as to hold center pins 15 rotatably in vertical postures.

The frame 9 is provided with two pairs 16, 17 of slider guides at its front lower and rear lower portions, respectively. Both the slider guides 16 and 17 at each portion have the same construction. That is, the slider guide consists of a vertical section 16*a* (17*a*) and a horizontal section 16*b* (17*b*). Each pair of slider guides are disposed such that the corresponding rails having a cross section of L-shape are arranged at a specified interval in a state wherein the ends of their horizontal sections 16*b*, 16*b* are made parallel in a manner to oppose each other, and also made substantially orthogonal to the longitudinal direction of the frame 9.

A slider 18 or 19 which is T-shaped in cross section is slidably disposed between the paired slider guides 16 or 17.

At the front and rear end portions of the frame 9, cylinders 20, 21 and 22, 23 which are disposed two in number for each end portion are disposed in series in a manner that their rods 20*a*, 21*a* and 22*a*, 23*a* are directed laterally outwardly of the frame 9. The outward tip end of each rod is connected to the corresponding slider 18, 18, 19 or 19, whereby the slider 18, 18, 19 or 19 is made slidable along the corresponding slider guide 16 or 17 through the operation of the corresponding cylinder.

Between the sliders 18 and 19 at the front and rear of the main frame section 2, a lower frame 24 constituted by lower frame members is connected thereto at the right and left side portions thereof, respectively. The lower frame 24 is connected, at the central portion thereof as viewed in the longitudinal direction, to a lower portion of the corresponding center pin 15. Thus, the connection between the lower frame 24 and the front slider 18 or back slider 19 is effected in such a manner that the former is rotatable about a connection pin 25 or 26 with respect to the latter. Each lower frame member 24 is provided, at its front and rear end protions, with the roller 5 or 6 via attachments 24*a* and 24*b*. In FIG. 4, a reference numeral 27 denotes a shaftsupporting portion, a reference numeral 28 denotes a vibrator, and a reference numeral 29 denotes an oil hydraulic motor.

The roller 5, 6 is formed into a usual cylindrical body and is formed, at the outer periphery of its end portions, with taper surfaces 6*a*, 6*a*.

An oil pressure circuit (not shown) for the cylinder and oil hydraulic motor is connected to the drive section 8, whereby the driving period of time, the amount driven, etc. are electrically controlled.

According to the invention having the foregoing construction, the automotive rolling machine can be moved or travelled as an ordinary automotive wheel-equipped body in such a manner that the running wheels 3, 4 are lowered beneath the rollers 5, 6. After its arrival at the actual rolling spot, the machine can be operated to perform its rolling work by driving the rollers 5 and 6 with the running wheels 3, 4 being lifted upwards.

Steering of the rollers 5, 6 are effected by suitably expanding and contracting the cylinders 20, 21, 22 and 23 mounted at the front and rear portions of the main frame section and rotating the rollers 5, 6 about their corresponding center pins 15. The amount of operation of each cylinder is controlled by pushing the operation buttons provided on an operation panel 8*a* of the drive section 8.

Figure 5:
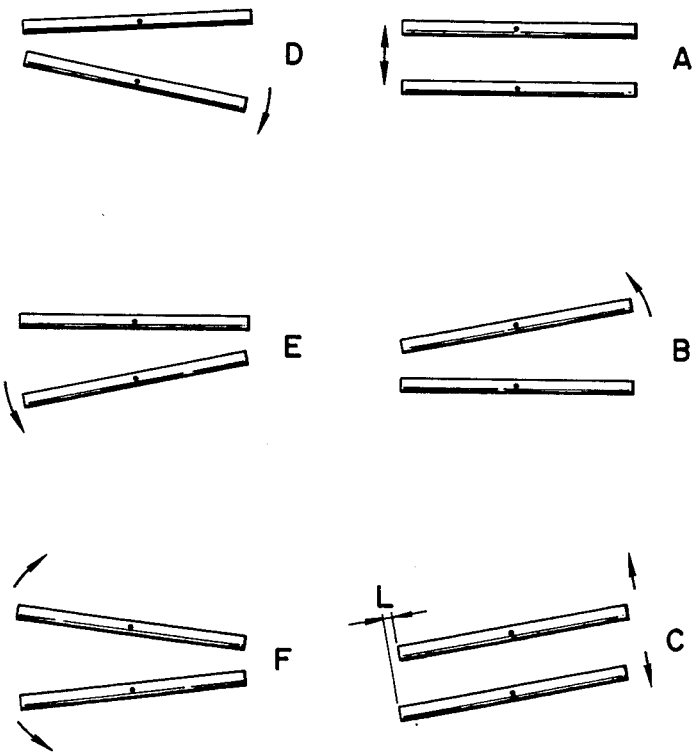

In the present invention, since the rollers are made rotatable about their central portions as viewed in the lingitudinal direction, where they are disposed respectively at both sides of the main frame section 2, it is possible to select the advancing direction of the machine to one of those which have been shown in FIG. 5 by alphabetic letters A, B, C, D, E and F. That is, A indicates the straight forward and backward direction of the machine, B the leftward rotational direction thereof, C the straight forward and backward directions thereof in which it is possible to increase the effective roller length by 2L. Further, D indicates the backward-/leftward rotational direction of the machine, E the backward/rightward direction thereof, and F the forward rightward and backward/rightward rotational directions thereof.

The invention is not limited to the above-mentioned construction. For example, although the slider guide was disposed orthogonally to the longitudinal direction of the main frame section of the machine, it can alternatively be disposed in the form of a circular arc using the center pin 15 as its center. In the former case, the lower frame members 24 would be smoothly rotatable if a space of suitable largeness were provided between the slider and the slider guide in the back-and-forth direction. Further, it is also possible to connect the lower frame members to the sliders via separate sliders making their sliding movements in the back-and-forth direction. Further, although the operation panel 8*a* was constructed to have manually operable buttons which are capable of operating the drive section by being pushed, its operation can be also performed through wireless operation using a wireless signal generated from a remote position.

Since the present invention has been constructed as described above, it has the following advantages.

(A) Since the rollers are caused to rotate about the center pins provided at their central portions as viewed in their longitudinal direction, even when they are as lengthy as 4 m or more, their advancing direction can be smoothly changed through an angle of small degree.

(B) Since the rollers are constructed such that the outer peripheries of their end portions are tapered, it is possible, at the time of changing the advancing direction, to prevent the paved surface from being damaged by the outer peripheral angular portions of their end portions.

(C) Since the end portions of the rollers are supported by the lower frame members and yet the end portions of these lower frame members are respectively fitted into the slider guides of the frame via the sliders, the rollers can be made to run in a stable condition even if they are 4 m or more in length. And, (D) Since the frame of the main frame section is constructed as a water tank, it is not necessary to install a water tank on the frame which would obstruct the machine operation. Besides, since the water adds its weight uniformly to the main frame section over its entire region, it is possible to increase the rolling effect by that extent.

What is claimed is:

1. An automotive rolling machine for use in paving a large, flat ground surface comprising:

a main frame section and a frame mounted therein having a longitudinal axis, an elongate pressure roller mounted to at least one side of the main frame section as viewed in the longitudinal direction of said frame, laterally extending slider guides provided at the front and rear of the underside of said frame, respectively, sliders for steering the roller and slidably fitted into said slider guides, at least one elongate center pin provided at a central portion of at least one side of said frame as viewed in the longitudinal direction thereof in such a manner that the longitudinal axis of said center pin is supported in a vertical orientation, said elongate center pin being mounted for pivotal movement with respect to said frame, at least one lower frame member for supporting said roller, said at least one lower frame member being fixed to a lower portion of said elongate center pin, respectively, said lower frame member being movably connected, at its front and rear end portions, to said sliders, and means for moving said slider relative to said frame whereby the longitudinal axis of said roller may effectively be pivoted relative to the longitudinal axis of said main frame, about a pivot axis that is coincident with the axis of said center pin(s), respectively, whereby the automotive rolling machine may be steered by an operator while it is in use, without deforming the surface to be paved with said roller.

2. An automotive rolling machine as set forth in claim 1, wherein said frame is constructed as a water tank.

3. An automotive rolling machine as set forth in claim 1, wherein said roller is provided, at the outer peripheries of its end portions, with tapered surfaces.

4. An automotive rolling machine as set forth in claim 1, wherein said moving means comprises a plurality of piston-cylinder assemblies.

5. An automotive rolling machine as set forth in claim 1, further including means for imparting vibration to said elongate roller.

6. An automotive rolling machine as set forth in claim 1, further including a plurality of retractable running wheels extending downwardly from said frame for driving said machine.

* * * * *